US007657958B2

(12) United States Patent
Korbonski et al.

(10) Patent No.: US 7,657,958 B2
(45) Date of Patent: Feb. 9, 2010

(54) METHOD AND APPARATUS FOR HOLDING ADHESIVE COATED ROLLER CLEANING SUBSTRATES

(76) Inventors: John A. Korbonski, 21 Morgan, Irvine, CA (US) 92618; Jon W. Korbonski, 21 Morgan, Irvine, CA (US) 92618

( * ) Notice: Subject to any disclaimer, the term of this patent is extended or adjusted under 35 U.S.C. 154(b) by 181 days.

(21) Appl. No.: 11/761,317

(22) Filed: Jun. 11, 2007

(65) Prior Publication Data

US 2008/0302387 A1 Dec. 11, 2008

(51) Int. Cl.
*A47L 25/00* (2006.01)

(52) U.S. Cl. ..... 15/104.002; 15/104.001; 15/257.01

(58) Field of Classification Search ..... 15/104.002, 15/104.001, 257.01
See application file for complete search history.

(56) References Cited

FOREIGN PATENT DOCUMENTS

JP 09-056661 * 3/1997

JP 11-332816 * 12/1999

OTHER PUBLICATIONS

Computer generated English translation of JP 11-332816, Dec. 1999, Nakano et al.*

* cited by examiner

*Primary Examiner*—Laura C Guidotti
(74) *Attorney, Agent, or Firm*—Larry K. Roberts

(57) ABSTRACT

An exemplary embodiment of a substrate cleaning apparatus includes a hand held hand roller including a roller cleaning member rotationally mounted in a handle and having a tacky peripheral contact surface, the tacky peripheral contact surface adapted to transfer foreign particles during cleaning of substrates. A roller cleaning substrate has opposed first and second surfaces. The first surface is coated with an adhesive adapted to transfer and retain said foreign particles from the surface of the roller for disposal; the second surface is a smooth surface. A mounting pad includes a soft layer of hardness lower than 100 Shore Hardness Scale A adapted to bond or adhere the second surface of the roller cleaning substrate to the mounting pad without the use of adhesives or mechanical clamping.

17 Claims, 4 Drawing Sheets

METHOD AND APPARATUS FOR HOLDING ADHESIVE COATED ROLLER CLEANING SUBSTRATES

BACKGROUND

Many industrial processes employ a cleaning method where a hand held tacky roller is used to remove and dispose of air borne contaminants from a surface of a panel or substrate prior to further processing. The hand held tacky roller, with its peripheral surface coated with tacky polymer and rotationally mounted in a handle, is passed over a substrate to be cleaned, to lift off the dust and, in the next step, to transfer the contaminants from the substrate to a cleaning sheet for disposal.

The cleaning sheet is typically mounted and held on a flat surface with the adhesive facing toward the operator who, when passing the hand roller over the adhesive, will transfer the collected contaminants to the cleaning sheet. Mounting of the cleaning sheet is sufficiently secure to prevent the cleaning sheet from rolling up on the roller during the cleaning process. Currently used mounting techniques for mounting the cleaning sheet to the flat surface include affixing the cleaning sheet to a work table with masking tape, or placing a bound pad of sheets, e.g. 50 sheets in a pad, in a pad holder which mechanically secures the pad. Such mounting techniques are cumbersome and limited.

The cleaning sheet is typically made either of plastic film or paper coated on one side with adhesive. The surface of the adhesive is protected by a removable liner. Prior to the actual cleaning of the hand roller, the protective liner is removed and discarded. The exposed adhesive of the cleaning sheet has a greater tack level than the tacky cleaning roller and the contaminants are transferred from the polymer coating of the roller to the cleaning sheet. When the cleaning sheet is loaded with contaminants to the point that it loses the ability to accept more dust, it is discarded and replaced with a new one.

Exemplary industrial applications of the tacky roller cleaning is the manufacturing process of printed circuit boards, screen printing, laminating and coating of substrates as well as in any applications where the surface of the substrate needs to be free of dust.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
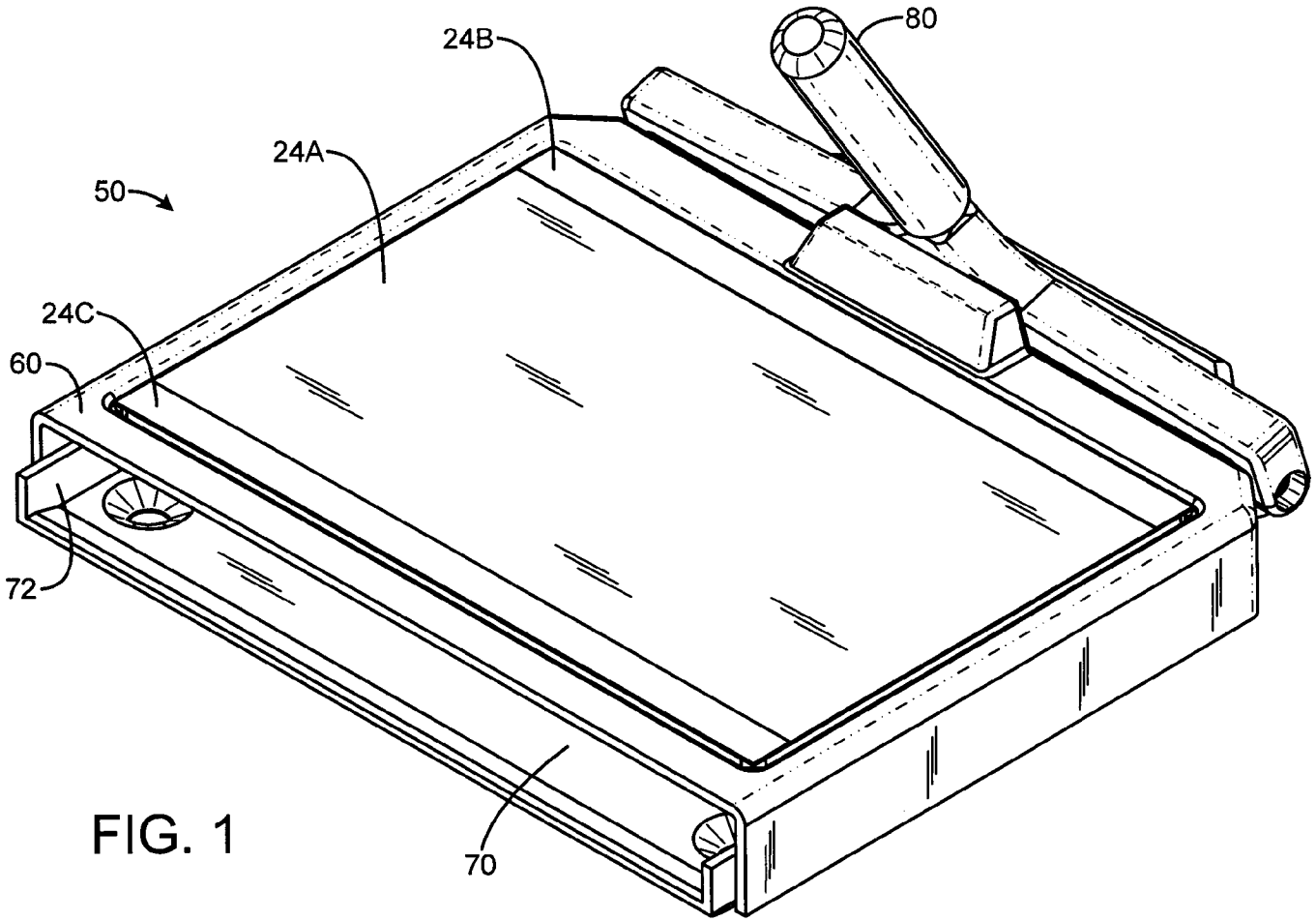
FIG. 1 is an isometric view of an exemplary embodiment of a cleaning layer mounting apparatus.

In the following detailed description and in the several figures of the drawing, like elements are identified with like reference numerals. The figures are not to scale, and relative feature sizes may be exaggerated for illustrative purposes.

Figure 2:
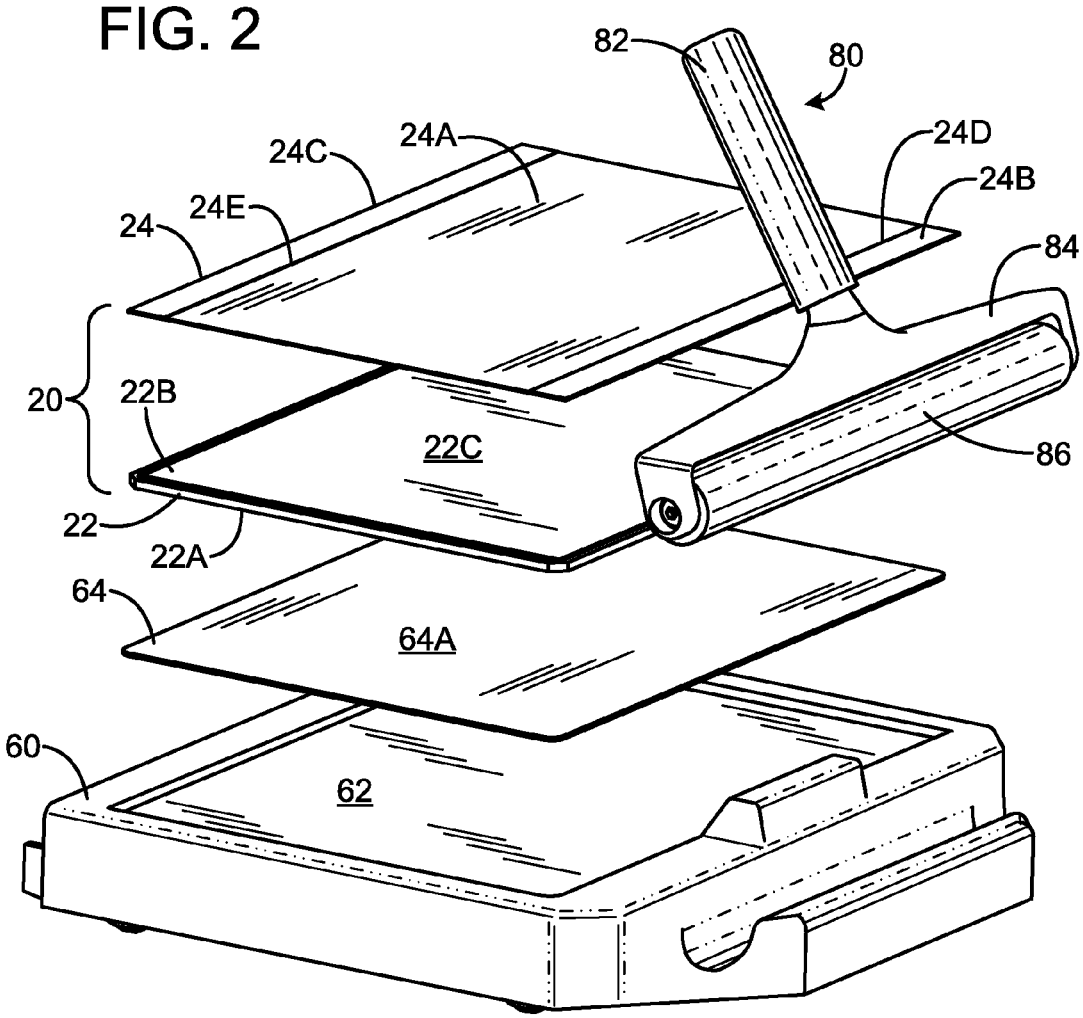
FIG. 2 is an exploded isometric view of the apparatus of FIG. 1.

An exemplary embodiment of a cleaning sheet mounting apparatus 50 is illustrated in FIGS. 1-2. The apparatus 50 includes a housing structure 60 which may be fabricated by molding a plastic material. The housing structure 60 includes a flat exposed surface 62 (FIG. 2) to which a cleaning sheet mounting pad 64 is affixed. The surface 62 may be defined in a recess in the housing structure.

The housing structure in this exemplary embodiment defines a space 70 for storing a supply of fresh roller cleaning substrates, which in this embodiment are sheets. Alternatively, the roller cleaning substrate may be in the form of a continuous roll, as discussed below. In an exemplary embodiment, the size of a cleaning sheet is selected to fit the size of the roller. The width of the sheet will be typically at least, but not limited to, one inch wider than the roller width and the height larger than two full turns of the roller when rolled in contact with the adhesive. One exemplary cleaning sheet is 13 inches wide and 9½ inches high.

The apparatus 50 includes a flat mounting pad 64 which is slightly larger or the same size as the cleaning sheet 20. The cleaning sheet mounting pad is made of a material exhibiting surface energy, such as, for example, rubber, rubber-like materials, soft silicone and urethane polymer, with an inherent tacky surface. Good contact between the adjoining surfaces, the mounting pad 64 and the cleaning sheet 20, allows the surface energy to develop into a strong bond. For that reason the surface of the mounting pad and the adjoining surface of the cleaning sheet are preferably smooth. In an exemplary embodiment, the mounting pad is fabricated of a material of hardness lower than 100 on Shore Hardness Scale A, with a thickness of ⅛ inch bonded to the flat surface 62 or any other flat surface using adhesive, adhesive tape or other bonding method. In a further example, the mounting pad is fabricated of a material of hardness lower than 60 on Shore Hardness Scale A. The housing structure 60 may be omitted for some applications, and the mounting pad 64 secured to a flat surface such as cleaning sheet mounting pad attached to any horizontal flat surface such as a work table or vertical surface such as wall, using adhesives, masking tape or mechanical clips and screws.

In an exemplary embodiment, the cleaning sheet 20 may be fabricated to utilize the surface energy of the soft surface of the mounting pad 64 to permit bonding the sheet and the surface of the pad. An exemplary embodiment of a cleaning sheet 20 suitable for the purpose is fabricated of a layer 22 of a flat smooth material, e.g. a plastic film or smooth paper and is coated on one side 22B with adhesive 22C. The adhesive coated surface is the working surface, which is used to clean the roller surface of particles. In an exemplary embodiment, the opposite side 22A of the cleaning sheet, not coated with the adhesive, is smooth and glossy to minimize any entrapment of air when in contact with the tacky surface of the mounting pad 64. An exemplary adhesive for coating the cleaning sheet is an adhesive with an acrylic base; other adhesives may alternatively be employed.

The adhesive-coated surface of the cleaning sheet 20 is protected by a sheet 24 of removable release liner. In an exemplary embodiment, there are two score lines 24D, 24E placed along the upper and lower edge of the protective release sheet, and after mounting to the pad, the middle portion 24A of the liner between the score lines is removed exposing the adhesive. The remaining narrow strips 24B, 24C of the release liner along the top and bottom edge of the cleaning sheet may be left in place on the adhesive to prevent lifting of the edge of the cleaning sheet by the hand roller during the cleaning contact.

In an exemplary embodiment, when the cleaning sheet is brought into contact with the mounting pad, it may bond with the soft polymer surface 64A via surface energy between the surfaces 64A and 22A. The sheet 20 and the pad 60 are adapted such that the sheet retaining force generated by the surface energy will be greater than the lifting or separating force of the hand roller applied to the adhesive coated side 22B of layer 20.

The cleaning sheet 20 when loaded with dust may be readily replaced with a fresh cleaning sheet. To accomplish this task, the operator will simply lift any corner of the spent sheet, and peal and discard the sheet from the mounting pad 64. The operator may then place a new cleaning sheet on the mounting pad, squeeze out any entrapped air with the hand roller and remove the middle section of the protective release sheet 24. When the adhesive on the cleaning sheet is exposed, the operator can return to the cleaning of substrates. In an exemplary embodiment, the whole process of removing the spent cleaning sheet and replacing it with the new one may be accomplished in less than one minute of operator's time.

An exemplary embodiment of the cleaning sheet 20 is made of two parts, the bottom sheet 22 made of a plastic film or glossy paper coated on one side 22B with adhesive 22C and protected by a release liner 24. The release liner can be made of either plastic or paper, for example. There are two score lines 24D and 24E, along the two edges of the liner sheet cut in the direction perpendicular to the movement of the roller 80 during a cleaning process. The bottom side 22A of the adhesive coated sheet 20 has a glossy finish which when in contact with the soft silicone rubber of the sheet mounting pad 3 develops a bonding force which will oppose lifting of the cleaning sheet 20 by the roller 80.

Cleaning of substrates with a hand held tacky roller is widely used in industrial applications. Such process employs a roller 80 as depicted in FIG. 2, with its peripheral roller surface 86 coated with tacky polymer and rotationally mounted on a handle 82 and bracket 84. The cleaning sheet 20, held on the sheet mounting pad 60, enables cleaning of the polymer coated surface 86 of the hand held roller 80.

In an exemplary embodiment, placement and mounting of the cleaning sheet 20 on the sheet mounting pad 60 may be easily accomplished. First, a fresh cleaning sheet is placed on the surface of the pad, with its adhesive coated side covered with the release liner facing away from the surface 64A of the pad 60. The upper edge of the sheet 20 is registered with the upper edge of the pad while lining up both the pad and the cleaning sheet so there is a full alignment. By rolling the surface 86 of the hand roller 80 over the whole surface of the release liner 24 and squeezing out any air pockets, the pad and the sheet are held together without the use of adhesives or mechanical clamping.

In the next step, the middle portion 24A of the release liner 24 between the score lines 24D and 24E is removing and discarded, exposing the adhesive surface. The cleaning sheet 20 is mounted and ready to clean contaminants from the polymer coated peripheral surface 86 of the hand roller 80.

When the surface of the adhesive is loaded with contaminants and the cleaning sheet needs to be changed, the operator will lift up any corner of the cleaning sheet and peel it off the pad, replacing it with a fresh cleaning sheet. The fresh cleaning sheet may be mounted on the pad repeating the same process.

Figure 3:
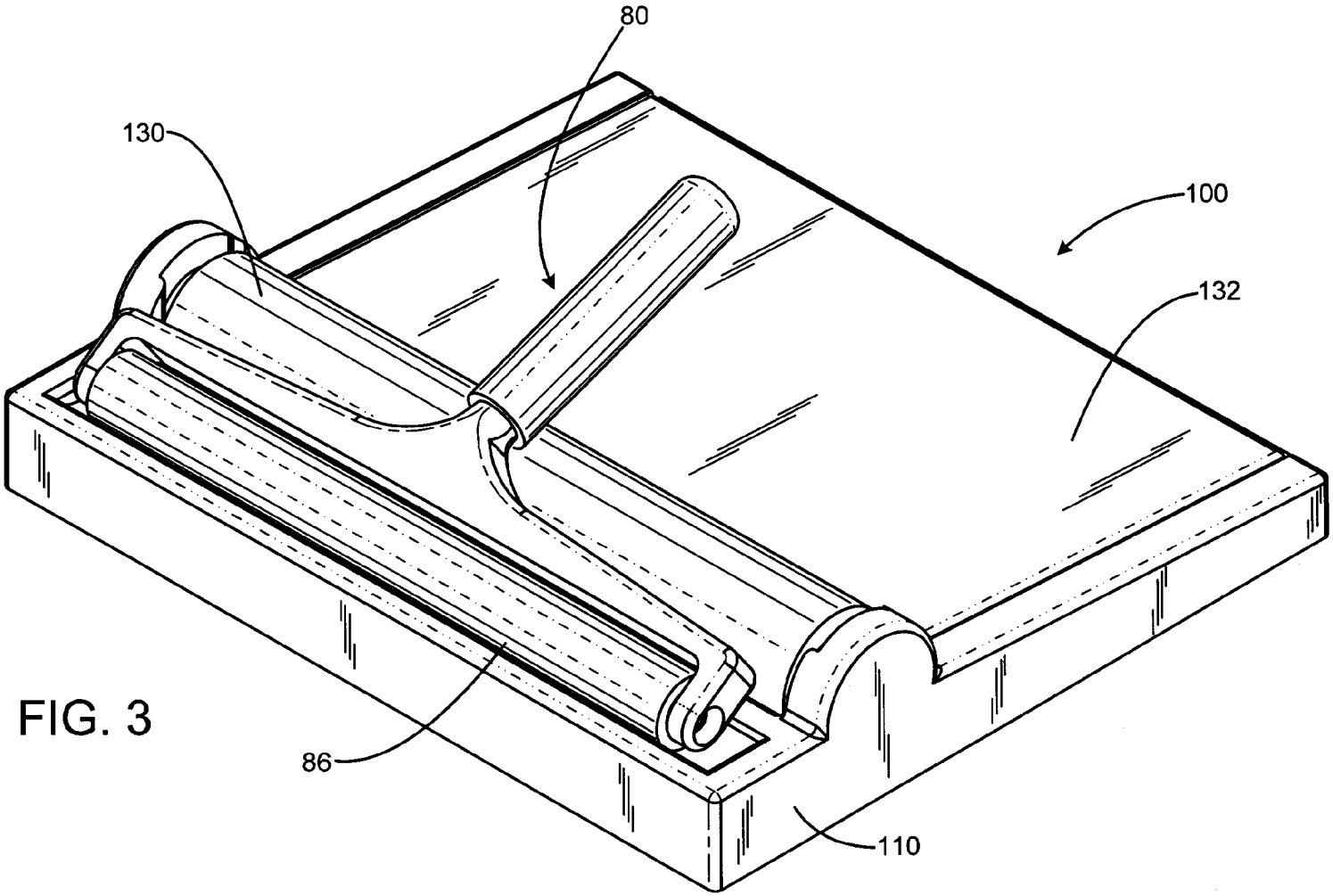
FIG. 3 is an isometric view of an alternate embodiment of a cleaning layer mounting and dispensing apparatus.
Figure 4:
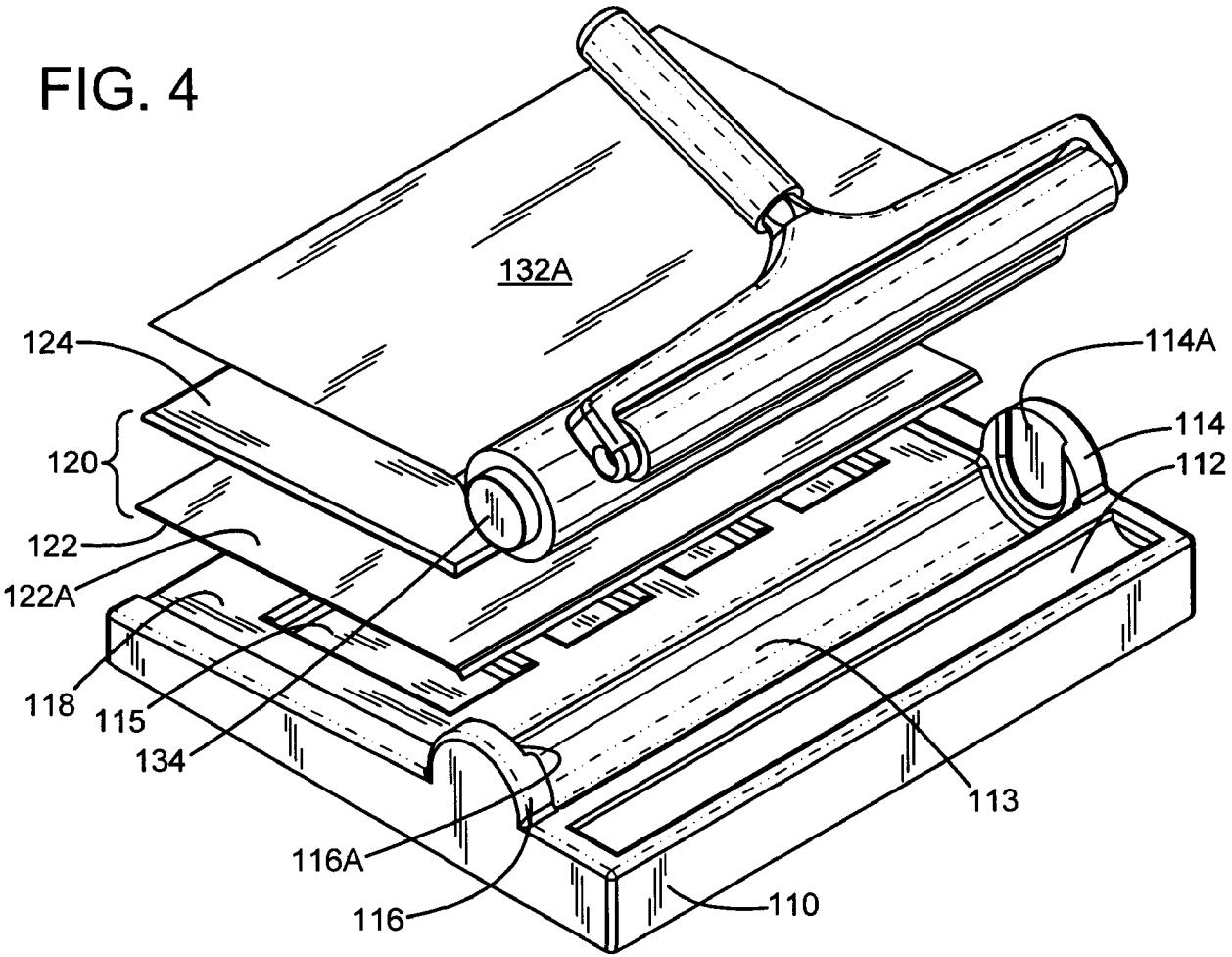
FIG. 4 is an exploded isometric view of the apparatus of FIG. 3.

FIGS. 3 and 4 illustrate an alternate embodiment of a roller cleaning apparatus in which the roller cleaning substrate is in the form of a continuous roll of material. This embodiment includes a housing structure 110, which may be fabricated of a molded rigid plastic material. The housing structure 110 defines a trough 112 in which the roller 80 may be stored when not in use. The housing structure further includes a roll trough 113 and opposed roll support bracket portions 114, 116. Each bracket portion includes a U-shaped channel 114A, 116A which receives the opposed ends of a roll tub or core 134 of the roll 130 and constrains movement of the roll core while allowing rotation of the core.

The housing structure further includes a mounting surface 118, in which several depressions 115 may be formed to strengthen the housing structure. A mounting pad structure 120 is attached to the surface 118, e.g. by adhesive or welding. The mounting pad structure 120 may include a thin sheet 122, e.g. ⅛ inch thick ABS, although other thin relatively rigid materials such as steel, aluminum, or even wood, may be employed in alternate arrangements. A thin layer 124 of a material exhibiting surface energy, such as, for example, rubber, rubber-like materials, soft silicone and urethane polymer, with an inherent tacky surface, is attached or applied to the top surface 122A of the sheet 122. In an exemplary embodiment, the layer 124 of a material exhibiting surface energy may be fabricated by coating the surface 122A with the material, e.g. silicon, to form the tacky surface of the pad structure. The material may be applied in a liquid state, and then cured to form the tacky pad surface.

The roll 130 of the roller cleaning material generally includes a continuous strip 132 of the roller cleaning material, which is wound on the roller core 134. The strip 132 may be fabricated of the same or a similar material to that used to fabricate the sheet 22 of the embodiment of FIGS. 1 and 2, e.g. a paper or plastic sheet with a smooth surface on a first side and an adhesive layer 132A formed on the opposed second side. In this example, a release liner may be omitted, with the strip rolled so that the adhesive coated surface faces inwardly on the roller core.

To use the apparatus 100, the user will pull the leading edge of the roll strip away from the roll, and position the leading edge at or past the distal edge of the mounting pad structure, with the smooth surface of the strip facing against the mounting pad structure. The user may roll the tacky surface 86 of the roller over the exposed adhesive layer on the surface of the substrate 132, from top to bottom, to transfer particulates from the roller surface onto the adhesive layer 132A while at the same time applying pressure to bond the smooth surface of the substrate 132 to the tacky surface of the mounting pad 120. Once the working portion of the strip 132 is loaded with particulates, the user may simply peel up the leading edge of the strip from the mounting pad, pull an additional length of the strip away from the roll and position it onto the mounting pad surface. A scissors, knife or edge may be used to cut off the used portion of the strip, leaving a fresh strip section in place on the mounting pad to be used to clean the roller.

Although the foregoing has been a description and illustration of specific embodiments of the subject matter, various modifications and changes thereto can be made by persons skilled in the art without departing from the scope and spirit of the invention as defined by the following claims.

What is claimed is:

1. A substrate cleaning apparatus, comprising:

a hand held hand roller including a roller cleaning member rotationally mounted in a handle and having a tacky peripheral contact surface, said tacky peripheral contact surface adapted to transfer foreign particles during cleaning of substrates;

a roller cleaning substrate having opposed first and second surfaces, and wherein the first surface is coated with an adhesive adapted to transfer and retain said foreign particles from the surface of the roller for disposal, and the second surface is a smooth surface;

a mounting pad including a layer of hardness lower than 100 Shore Hardness Scale A, said layer adapted to bond the second surface of the roller cleaning substrate to the mounting pad without the use of adhesives or mechanical clamping; and wherein the mounting pad has a smooth surface configured to be brought into contact with the second surface of the cleaning substrate, and where the cleaning substrate is held on the mounting pad only by surface energy between the second surface of the cleaning substrate in contact with the smooth surface of the mounting pad, the cleaning substrate and the mounting pad being adapted such that a substrate retaining force generated by the surface energy will be greater than the lifting or separating force of the hand roller applied to the adhesive coated side of the cleaning substrate.

2. The apparatus of claim 1, further comprising:

a housing structure including a generally planar mounting surface for locating the mounting pad.

3. The apparatus of claim 2, wherein the housing structure further includes a space for storing a supply of fresh cleaning substrates.

4. The apparatus of claim 2, wherein the housing structure further includes a hand held roller stowage space for stowing the hand held roller when not in use.

5. The apparatus of claim 1, wherein substrate is a sheet, and the mounting pad is sized to be slightly larger or the same size as the cleaning sheet.

6. The apparatus of claim 1, wherein the mounting pad is fabricated of a rubber, soft silicone or urethane polymer with a tacky surface.

7. The apparatus of claim 1, wherein the roller cleaning substrate includes a plastic film or smooth paper layer defining the first and second surfaces.

8. The apparatus of claim 1, wherein the mounting pad is attached to a flat surface using adhesives, masking tape, mechanical clips or screws.

9. The apparatus of claim 1, wherein the roller cleaning substrate is in continuous roll form, comprising a continuous strip of the roller cleaning substrate.

10. The apparatus of claim 9, further comprising a housing structure including bracket portions for constraining the roll or a roll core while allowing the roll to rotate to unwind fresh portions of the continuous strip, the mounting pad attached to the housing structure.

11. A substrate cleaning apparatus, comprising:

a hand held hand roller including a roller cleaning member rotationally mounted in a handle and having a tacky peripheral contact surface, said tacky peripheral contact surface adapted to transfer foreign particles during cleaning of substrates;

a roller cleaning substrate having opposed first and second surfaces, and wherein the first surface is coated with an adhesive adapted to transfer and retain said foreign particles from the surface of the roller for disposal, and the second surface is a smooth surface;

a mounting pad including a layer of hardness lower than 100 Shore Hardness Scale A, said layer adapted to bond the second surface of the roller cleaning substrate to the mounting pad without the use of adhesives or mechanical clamping; and wherein the roller cleaning substrate further includes:

a protective release layer adhered to the adhesive coated first surface, the release layer having first and second score lines with an intermediate portion of the release layer between the first and second score lines adapted to be removed exposing the adhesive and leaving first and second narrow strips of the release layer along upper and lower edges of the cleaning substrate to prevent lifting off the cleaning substrate from the mounting pad.

12. The apparatus of claim 11 wherein the first and second narrow strips of release liner are generally perpendicular to the direction of travel of the hand roller during a cleaning process, and are adapted to prevent a lifting the leading edge of the cleaning substrate by the hand roller.

13. An apparatus for holding an adhesive coated cleaning substrate structure used to clean a hand held tacky roller including a roller cleaning member rotationally mounted in a handle and having a contact surface, the contact surface adapted to transfer foreign particles to its peripheral surface from a substrate, comprising:

the roller cleaning substrate having opposed first and second surfaces, and wherein the first surface is coated with an adhesive adapted to transfer and retain said foreign particles from the surface of the roller for disposal, the second surface is a smooth surface;

a mounting pad including a layer of hardness lower than 100 Shore Hardness Scale A, said layer and said second surface of said cleaning substrate adapted to bond together upon application of pressure without the use of adhesives or mechanical clamping; and wherein the cleaning substrate is held on the mounting pad only by surface energy between the second surface of the cleaning substrate in contact with the mounting pad, the cleaning substrate and the mounting pad being adapted such that a substrate retaining force generated by the surface energy will be greater than the lifting or separating force of the hand roller applied to the adhesive coated side of the cleaning substrate.

14. The apparatus of claim 13, wherein the mounting pad is fabricated of a rubber, soft silicone or urethane polymer with a tacky surface.

15. An apparatus for holding an adhesive coated cleaning substrate structure used to clean a hand held tacky roller including a roller cleaning member rotationally mounted in a handle and having a contact surface, the contact surface adapted to transfer foreign particles to its peripheral surface from a substrate, comprising:

the roller cleaning substrate having opposed first and second surfaces, and wherein the first surface is coated with an adhesive adapted to transfer and retain said foreign particles from the surface of the roller for disposal, the second surface is a smooth surface;

a mounting pad including a layer of hardness lower than 100 Shore Hardness Scale A, said layer and said second surface of said cleaning substrate adapted to bond together upon application of pressure without the use of adhesives or mechanical clamping;

where the cleaning substrate is held on the mounting pad only by surface energy between the second surface of the cleaning substrate in contact with the mounting pad, the cleaning substrate and the mounting pad being adapted such that a substrate retaining force generated by the surface energy will be greater than the lifting or separating force of the hand roller applied to the adhesive coated side of the cleaning substrate; and wherein the cleaning substrate is in the form of a sheet, and further comprising:

a protective release sheet adhered to the adhesive coated first surface, the release sheet having first and second score lines with a center portion of the release sheet between the first and second score lines adapted to be removed exposing the adhesive and leaving first and second narrow strips of the release sheet along upper and lower edges of the cleaning sheet to prevent lifting off the cleaning substrate from the mounting pad.

16. The apparatus of claim 15 wherein the first and second narrow strips of release liner are generally perpendicular to the direction of travel of the hand roller during a roller cleaning process, and are adapted to prevent a lifting the leading edge of the cleaning sheet by the hand roller.

17. The apparatus of claim 15, wherein the mounting pad is sized to be slightly larger or the same size as the cleaning substrate.

* * * * *